US006151837A

United States Patent [19]

Ealer, Sr.

[11] Patent Number: 6,151,837

[45] Date of Patent: Nov. 28, 2000

[54] PERFORATED SHEET GUTTER SCREEN

[76] Inventor: James Edward Ealer, Sr., P.O. Box 188, St. Clair, Mo. 63077

[21] Appl. No.: 09/187,870

[22] Filed: Nov. 6, 1998

[51] Int. Cl.[7] ..... E04D 13/064

[52] U.S. Cl. ..... 52/12; 52/11; 52/13

[58] Field of Search ..... 52/11, 12, 13

[56] References Cited

U.S. PATENT DOCUMENTS

| | | | |
|---|---|---|---|
| 2,175,521 | 10/1939 | Fry . | |
| 2,271,081 | 1/1942 | Layton | 52/12 |
| 3,388,555 | 6/1968 | Foster | 52/12 X |
| 3,950,951 | 4/1976 | Zukauskas | 52/12 |
| 4,418,504 | 12/1983 | Lassiter | 52/12 |
| 4,631,875 | 12/1986 | Olson | 52/12 |
| 4,727,689 | 3/1988 | Bosler | 52/12 |
| 4,905,427 | 3/1990 | McPhalen | 52/12 |
| 4,907,381 | 3/1990 | Ealer . | |
| 4,937,986 | 7/1990 | Way, Sr. et al. | 52/12 |
| 5,251,410 | 10/1993 | Carey | 52/12 |
| 5,271,191 | 12/1993 | Vahamaki | 52/12 |
| 5,271,192 | 12/1993 | Nothum, Sr. et al. . | |
| 5,709,051 | 1/1998 | Mazziotti | 52/12 |
| 5,813,173 | 9/1998 | Way, Sr. | 52/12 |
| 5,842,311 | 12/1998 | Morin | 52/12 |

OTHER PUBLICATIONS

Petit Tool "Gutter Guard For 5" or 6" Gutter," date unknown, pp. 1–2 photographs of sample Gutter Guard, p. 3 brochure accompanying sample, admitted prior art.

*Primary Examiner*—Carl D. Friedman
*Assistant Examiner*—Phi Dieu Tran A
*Attorney, Agent, or Firm*—Senniger, Powers, Leavitt & Roedel

[57] ABSTRACT

A gutter screen for covering a gutter and preventing debris from falling into the gutter. The gutter screen has an elongate sheet metal member sized and shaped to engage a portion of the gutter and to cover the gutter. The sheet metal member has a generally smooth top surface and a plurality of channels and slots. The channels extend transverse to an axis of the member and the slots extend parallel to the axis. Each channel extends downward and away from the top surface and has a lower end that defines a lower portion of the periphery of one of the slots. The channels are aligned in rows extending parallel to the axis. An unbroken portion of the smooth top surface extends between upper ends of the channels of one row and the slots in an adjacent row. The channels are formed from the material of the sheet metal member. Each channel and slot is sized so that water is directed into the channel, through the slot and into the gutter and so that debris is not trapped in the channel and the slot.

21 Claims, 5 Drawing Sheets

70
72
74
75
76
78
80
82
84
34
54
6
6A
5

PERFORATED SHEET GUTTER SCREEN

BACKGROUND OF THE INVENTION

The present invention relates generally to rain gutters and more particularly to a gutter screen for such gutters. Since leaves and other debris frequently clog up rain gutters, some kind of guard or screen which prevents debris from falling into the gutter is desirable. Ideally, a gutter screen directs water into the gutter, prevents debris from entering the gutter, does not itself become clogged with debris and is securely attached to the gutter. The ideal gutter screen requires no maintenance after installation.

Conventional gutter screens are made of hardware cloth, expanded metal or perforated sheet metal, which have holes that often trap debris instead of allowing the debris to slide over the screen. Debris may build up in the holes and cause rainwater to bypass the holes and flow over the gutter instead of into the gutter, or may cause rainwater to build up above the gutter. The debris must thereafter be removed from the screens by hand. Thus, many conventional gutter screens are not maintenance free.

Some prior art screens have holes of smaller diameter to prevent debris from becoming trapped. However, these smaller holes do not allow enough rainwater to flow into the gutter during a heavy rainfall. This is undesirable because the excess water may back up above the gutter or may flow over the screen and gutter.

SUMMARY OF THE INVENTION

Among the several objects and features of the present invention may be noted the provision of an improved gutter screen which prevents leaves and other debris from entering the gutter; the provision of such a gutter screen that is less prone to become clogged with leaves and other debris; the provision of such a gutter screen that is easy to install and securely connects to the gutter; and the provision of such a gutter screen that requires little if any maintenance.

Briefly, this invention is directed to a gutter screen for covering a gutter and preventing debris from falling into the gutter. The gutter screen comprises an elongate sheet metal member which is sized and shaped to engage a portion of the gutter and to cover the gutter. The sheet metal member has a generally smooth top surface and a plurality of channels and slots. The channels extend transverse to an axis of the member and the slots extend parallel to the axis. Each channel extends downward and away from the top surface and has a lower end that defines a lower portion of the periphery of one of the slots. The channels are aligned in rows extending parallel to the axis. An unbroken portion of the smooth top surface extends between upper ends of the channels of one row and the slots in an adjacent row. The channels are formed from the material of the sheet metal member. Each channel and slot is sized and shaped so that water is directed into the channel, through the slot and into the gutter and so that debris is not trapped in the channel and the slot.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
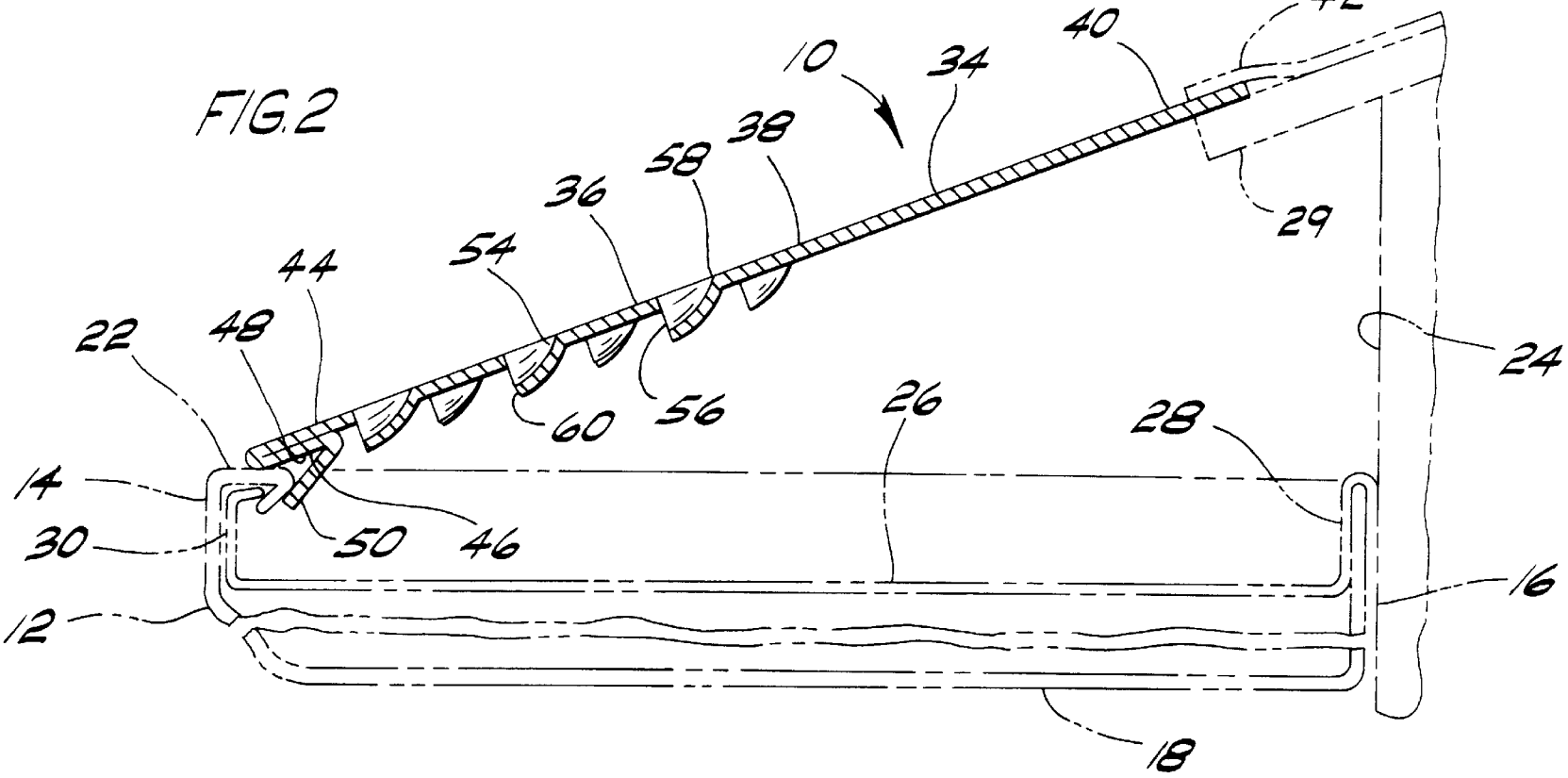
FIG. 2 is a vertical cross section taken in the plane of line 2—2 of FIG. 1.

Now referring to the drawings, a perforated sheet gutter screen of the present invention is generally designated 10. The gutter screen is particularly adapted for covering a conventional rain gutter 12 and preventing debris from falling into the gutter. As shown in FIG. 2, the gutter 12 has a front wall 14, a back wall 16 and a bottom wall 18, which combine to form a channel for drainage of rainwater. A conventional flange 22 projects rearwardly (i.e., toward the building) from the upper edge of the front wall 14. The gutter 12 is suitably attached to a wall 24 of the building by gutter hangers 26, one of which is shown. The hanger has a back portion 28 bent to hook over the back wall 16 of the gutter 12 and receives a fastening device, such as a screw or nail, to secure the gutter to the wall 24 adjacent the roof 29. The hanger 26 extends over the gutter channel to the front wall 14 and has a front portion 30 bent up to fit inside the flange 22 for supporting the front wall.

The gutter screen 10 comprises an elongate sheet metal member 34 having a central section 36 that includes a generally smooth top surface 38 and an integral rear edge margin 40 that is adapted to be slipped between a shingle 42 of the roof 29 and the underlying roof material, as shown in FIG. 2. The sheet metal member 34 also has an integral front edge margin 44 opposite the rear edge margin 40 and generally parallel to the rear edge margin. The front edge margin 44 is configured for attachment to the gutter 12 in a manner disclosed in U.S. Pat. No. 4,907,381, which is incorporated herein by reference. Briefly, the front edge margin 44 is bent to form a forwardly-opening groove 46 having a generally V-shaped configuration in transverse section and thereby adapted for receiving the flange 22 of the gutter 12 therein. For example, a rearwardly extending portion 48 may be bent back from the front edge of the sheet metal member 34 so as to extend generally parallel to the sheet metal member, and a forwardly extending portion 50 may be bent forward from the rearwardly extending portion at an angle of approximately 45 degrees therefrom. The rearwardly extending and forwardly extending portions 48, 50 are divergent in the forward direction to form the groove 46 for receiving the gutter flange 22 in a position where the flange is held captive between the portions. Other configurations may also be suitable and are within the scope of this invention.

Figure 1:
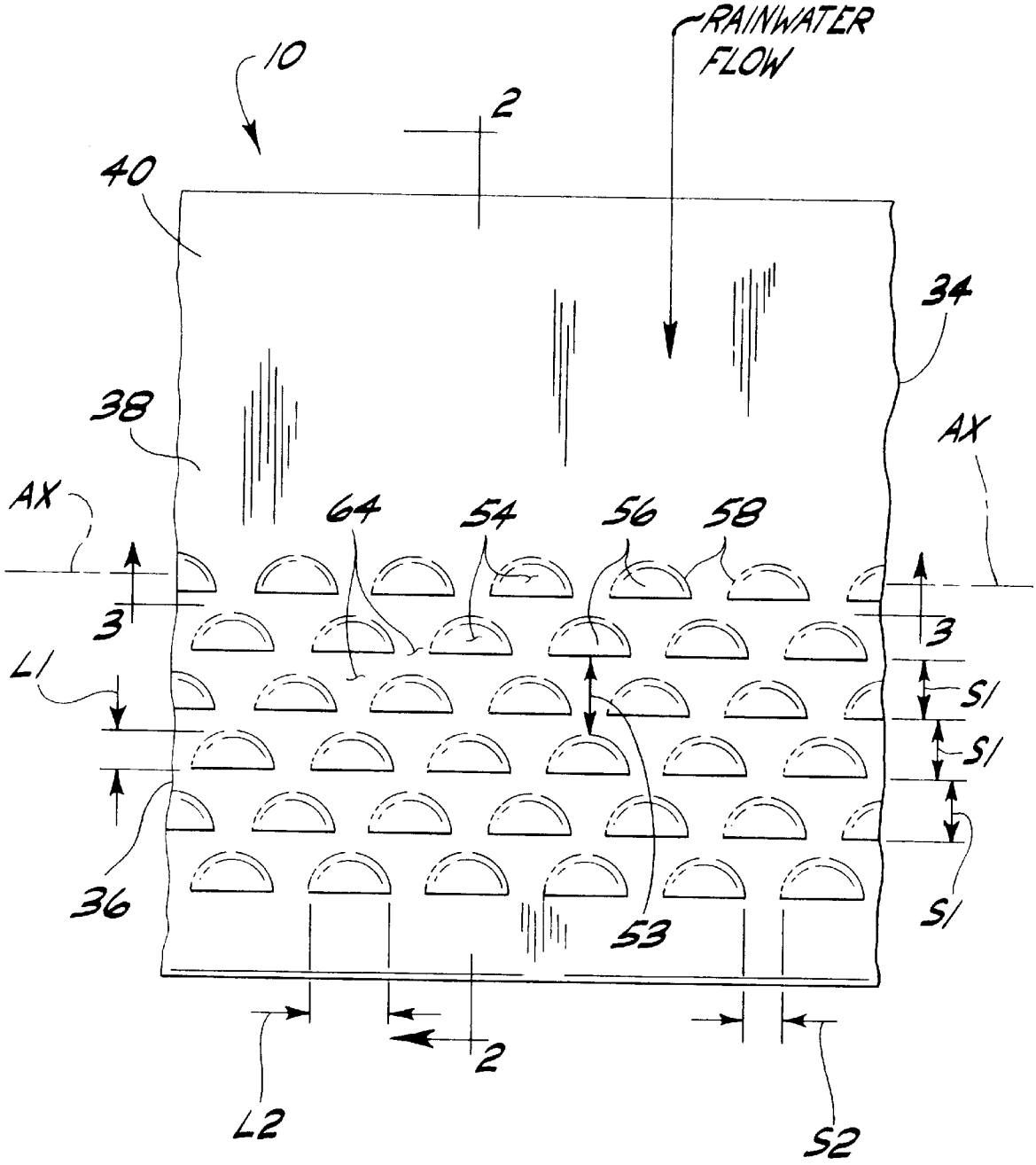
FIG. 1 is a fragmentary plan view of a perforated sheet gutter screen of the present invention.

The central section 36 of the sheet metal member 34 is substantially continuous, unbroken and uninterrupted except for a plurality of channels 54 and slots 56 which are sized and shaped to allow water to flow through the channels and slots while ensuring that debris is not trapped in the screen 10. Each channel 54 extends downward and away from the top surface 38 of the sheet metal member 34 and is formed integrally with the sheet metal member. Preferably, each channel 54 curves as it extends downward and away from the top surface 38 such that it has a generally concave profile, as best illustrated in FIG. 2. This profile has been found to help allow more water to enter the channel 54 and to substantially prevent debris from entering. As shown in FIG. 1, each channel 54 extends transverse to a longitudinal axis AX of the sheet metal member 34, and its leading (upstream) edge 58 is positioned at its rearward (upper) end so that water flowing from the roof 29 enters each channel at the leading edge. The leading edge 58 of each channel 54 defining the entrance to the channel is preferably curved. More preferably, the leading edge 58 is elliptical and extends farthest rearward at a central portion of the channel 54. The channels have a length L1 (shown in FIG. 1) measured parallel to the plane of the top surface 38 and perpendicular to the longitudinal axis AX of the sheet metal member 34 that is preferably between about 0.19 and 0.5 inches, and more preferably about 0.25 inches. The length and shape of the channel 54 are chosen to prevent debris from entering the channel, while allowing sufficient flow of water into the channel.

Figure 3:
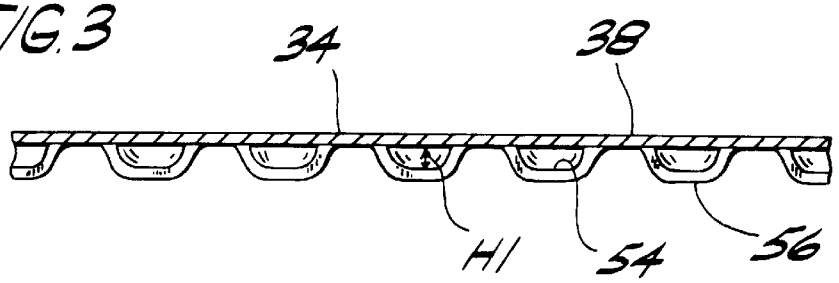
FIG. 3 is a vertical cross section taken in the plane of line 3—3 of FIG. 1.

Referring to FIGS. 2 and 3, the lower (forward) edge 60 of each channel 54 defines a lower portion of the periphery of one of the slots 56. Each slot extends generally parallel to the longitudinal axis AX of the sheet metal member 34 and is defined by the lower edge of a respective channel 54 and the bottom surface of the sheet metal member disposed immediately thereabove. (The slot 56 lies in a plane generally perpendicular to the top surface 38 of the sheet metal member 34.) Preferably, the slot 56 has a length L2 (see FIG. 1) extending parallel to the longitudinal axis AX of between about to 0.25 and 0.75 inches, and more preferably has a length of about 0.5 inches. Preferably, the slot 56 has a height H1 (FIG. 3) extending perpendicular to the top surface 38 of between about 0.06 and 0.16 inches, and more preferably has a height of about 0.09 inches. Like the length L1 of the channel 54, the slot length L2 and height H1 are chosen to limit the debris that is caught in the slot, while allowing a sufficient amount of water to flow through the slot.

The channels 54 and slots 56 are aligned in rows extending parallel to the longitudinal axis AX. In this embodiment, six rows of channels 54 are shown, but it is to be understood that more or less rows may be used within the scope of this invention. An unbroken portion 64 of the smooth top surface 38 extends between adjacent channels 54 and slots 56 and between the rows. Increasing the area of the unbroken portion 64 is desirable because the unbroken portion serves to deflect or guide debris over the channels 54 so that debris is not trapped in the slots 56 or channels. Preferably, the spacing S1 (shown in FIG. 1) between adjacent rows is relatively wide to increase the area of the unbroken portion 64 between rows, especially the area of unbroken portion that is rearward (upstream) of the leading edge 58 of each channel 54. For example, the spacing S1 between adjacent rows is between about 0.25 and 0.5 inches. The rows are preferably evenly spaced apart, although it is within the scope of this invention to vary the spacing between rows. The slots 56 in each row are also preferably evenly spaced apart a distance S2 that is preferably between about 0.125 and 0.38 inches so that the unbroken portion 64 extending between slots 56 is between about 0.125 and 0.38 inches, and more preferably is about 0.25 inches. The unbroken portion 64 of the smooth top surface 38 therefore extends between adjacent slots 56 in each row.

As shown in FIG. 1, the channels 54 in adjacent rows are offset or staggered relative to one another in the direction of the longitudinal axis AX such that each of the channels in one row overlaps the unbroken portion 64 between two adjacent channels in the other row. The unbroken portion 64 of the smooth top surface 38 extends rearwardly (upstream) a distance S3 from the leading edge 58 of each channel 54 through the space between channels in the adjacent row to the slot 56 in the next adjacent row. Thus, the staggered rows increase the area of the unbroken portion 64 positioned rearward of each channel 54. As water and debris contact the leading edge 58 of the channel 54 from the unbroken portion 64, the water tends to follow the channel downward into the slot 56, while most debris will pass over the channel and the slot. Water, because of surface tension, tends to stick to the surface it is flowing over. The leading edge 58 at the upper end of the channel 54 incorporates this surface tension principle of the water and causes the water to enter the channel. Most debris will flow over or around the channel 54 due to the fact that the channel is relatively narrow and short. This configuration facilitates separation of debris from the water so as to avoid debris becoming trapped in the slot 56.

The sheet metal member 34 is formed of flexible resilient metal, such as aluminum, plastic or steel alloy, so that the screen may flex during installation, and it is of integral construction, that is, it is formed from a single continuous section of metal. Preferably, the sheet metal member 34 is aluminum and is between about 0.016 and 0.024 inches thick, and more preferably is about 0.019 inches thick. However, other materials, and other thicknesses of material are within the scope of this invention.

Figures 4, 5, 6, 6A:
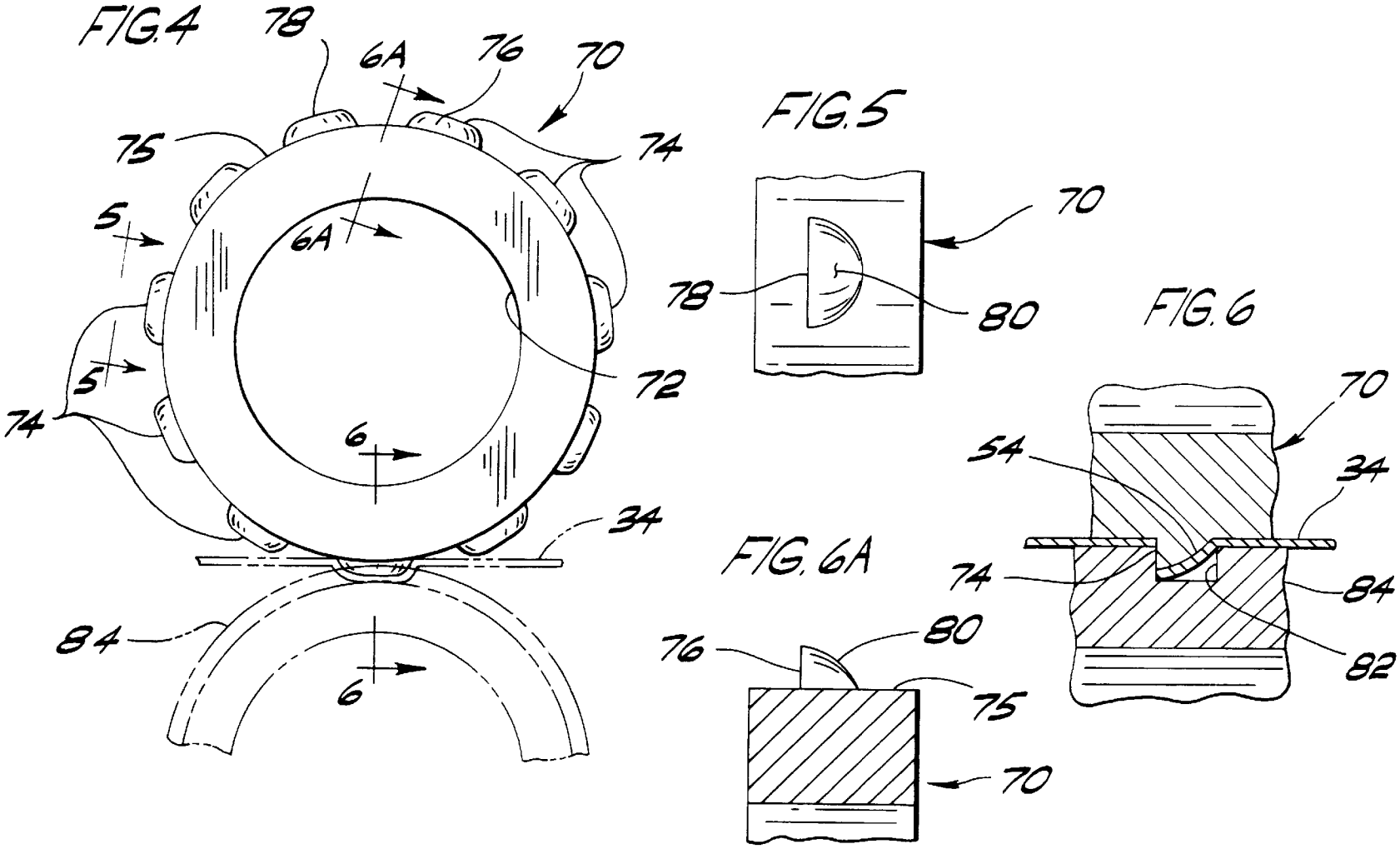
FIG. 4 is a side elevation of an exemplary die used to manufacture the gutter screen.
FIG. 5 is an enlarged fragmentary view taken in the plane of line 5—5 of FIG. 4.
FIG. 6 is an enlarged cross section taken in the plane of line 6—6 of FIG. 4.
FIG. 6A is an enlarged cross section taken in the plane of line 6A—6A of FIG. 4.

Referring to FIGS. 4 and 5, a male die particularly adapted for manufacturing the screen 10 of this invention is generally designated 70. The male die is generally annular in shape, having a central bore 72 therethrough. Punch elements 74 protrude radially from the periphery 75 of the male die 70 and are sized and shaped for forming the channels 54 and slots 56 described above. Each punch element 74 has a front face 76 which extends radially outward from the periphery 75 of the male die 70 and defines a sharp cutting edge 78 for cutting the slot 56 in the sheet metal member 34. The punch element 74 also has a sloped surface 80 which extends rearward and radially inward from the cutting edge 78 to define a convex profile (see FIGS. 6 and 6A) for forming the concave profile of the channel 54. The punch elements 74 of the male die mate with a circumferential channel 82 in a female die 84 having an annular shape like that of the male die 70. In operation, the dies 70, 84 rotate in opposite directions about their axes and the sheet metal member 34 is fed between the dies in a direction corresponding to the longitudinal axis AX of the member. In this way, the channels 54 and slots 56 can be rapidly formed in the member 34. Preferably, several male dies 70 and mating female dies 84 operate concurrently on the same sheet metal member 34 so that several rows of channels 54 and slots 56 are concurrently formed.

Figure 7:
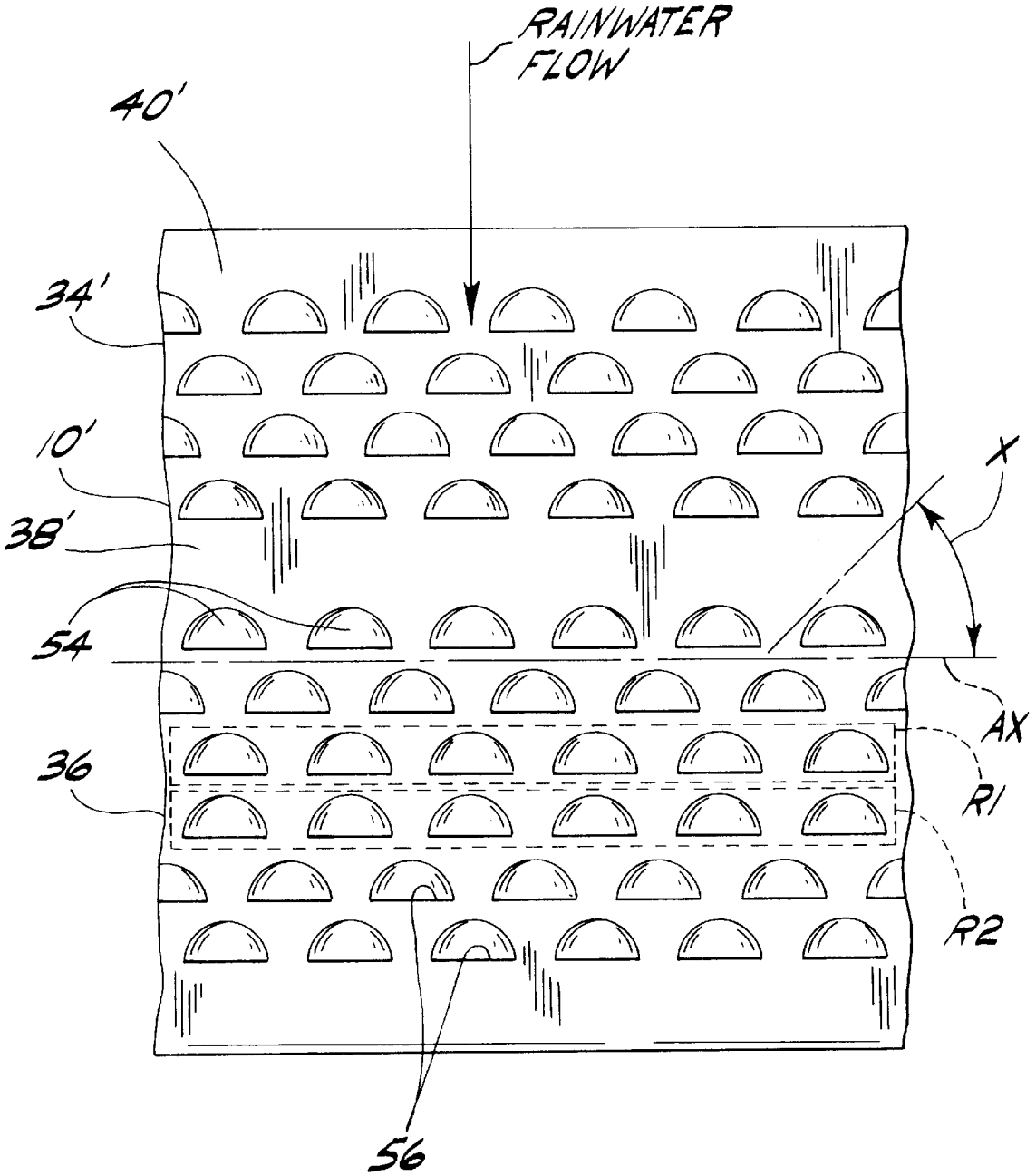
FIG. 7 is a fragmentary plan view like FIG. 1 but showing a second embodiment of the invention.
Figure 8:
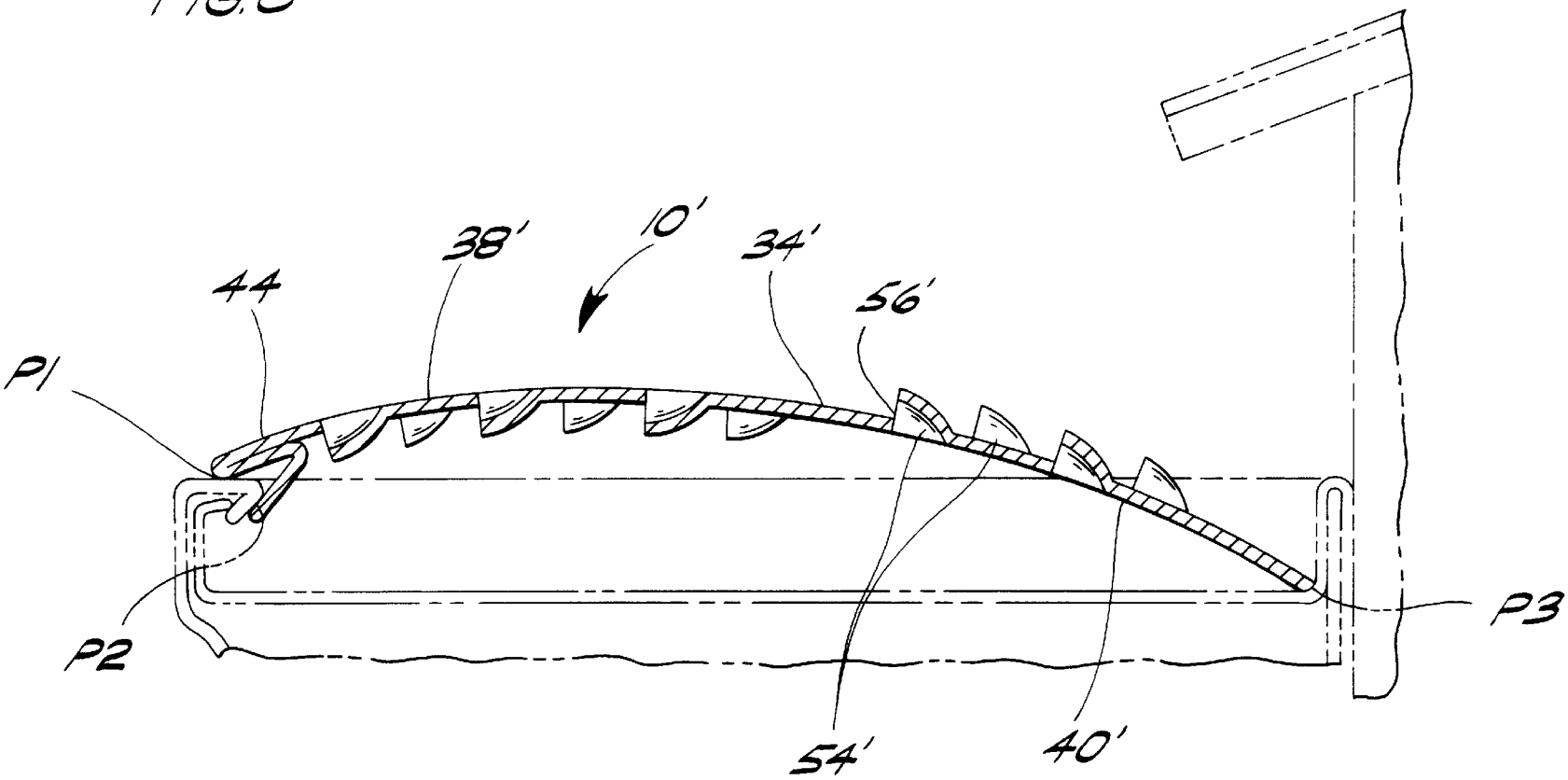
FIG. 8 is a vertical cross section like FIG. 2 but showing the second embodiment.

Referring to FIGS. 7 and 8, a second embodiment of the screen 10' is shown. In this embodiment, the rear edge margin 40' of the sheet metal member 34' includes several rows of channels 54' and slots 56' that extend upward from the smooth top surface 38'. The size and shape of the channels 54' and slots 56' is preferably identical to the size and shape of the channels and slots described above. These upturned channels 54' and slots 56' capture more water than the channels and slots in the central section, and because of their position under the roof are unlikely to trap debris. The channels 54 and slots 56 in the central section 36 are preferably in the same formation as in the first embodiment except that the channels in one row R1 are aligned with the channels of an immediately adjacent row R2 in a direction transverse to the longitudinal axis AX. This pattern is advantageous because it ensures that water flowing at an angle X to the longitudinal axis (about 45 degrees in this embodiment) flows into a channel.

The screen 10' of the second embodiment is installed as shown in FIG. 8 and as described in U.S. Pat. No. 4,907,381. Briefly, the front edge margin 44 is secured as described above with respect to the first embodiment, and the rear edge margin 40' is adapted to engage the bend in the hanger adjacent the back wall 16 of the gutter. The width of the screen 10' (i.e., from front edge margin 44 to rear edge margin 40') is greater than the width of the gutter 12 (i.e., between the bend in the hanger and the flange) so that the screen may be resiliently bent to the arcuate configuration shown in FIG. 8. The front edge margin 44 and rear edge margin 40' of the screen 10 are in pressure engagement with the gutter 12 and hanger 26 at points P1, P2 and P3, respectively, thereby securing the screen on the gutter. The arched configuration of the screen 10' also increases the load bearing capability of the screen.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A gutter screen for covering a gutter and preventing debris from falling into the gutter, said gutter screen comprising:

an elongate sheet metal member sized and shaped to engage a portion of the gutter and to cover the gutter, said member having a longitudinal axis and a generally smooth top surface interrupted by a plurality of channels and slots formed therein, said channels extending generally transverse to said axis and said slots extending generally parallel to the axis, each channel extending down and away from the smooth top surface, each channel defining a concave profile in cross-section taken longitudinally with respect to the channel as the channel extends down and away from the top surface and further having a lower end that defines a lower portion of the periphery of one of said slots, said channels being aligned in rows extending parallel to said axis, a continuous, uninterrupted and unbroken portion of the top surface extending between adjacent channels and slots and between said rows, said channels being formed from the material of the sheet metal member, the upper end of each channel including a leading edge which is curved substantially along its full length, each channel and slot being sized and shaped so that water is directed into the channel, through the slot and into the gutter and so that debris is not trapped in the channel and the slot.

2. A gutter screen as set forth in claim 1 in combination with the gutter which is mounted adjacent a roof, said gutter screen mounted in the gutter such that the leading edge of each channel is positioned nearer to the roof than the slot at the lower end of the channel so that water flows over the leading edge and into the slot.

3. A gutter screen as set forth in claim 2 wherein the leading edge of each channel is part elliptical.

4. A gutter screen as set forth in claim 1 wherein said slots have a length of less than about 0.75 inches and a height of less than about 0.16 inches, and wherein said channels have a length measured perpendicular to said axis of less than about 0.5 inches.

5. A gutter screen as set forth in claim 1 wherein said slots have a length of about 0.5 inches and a height of about 0.09 inches, and wherein said channels have a length measured perpendicular to said axis of about 0.25 inches.

6. A gutter screen as set forth in claim 1 wherein said channels in each row are substantially evenly spaced apart and wherein the channels in at least two adjacent rows are staggered relative to one another in the direction of said axis such that each of the channels in one row overlaps an area between two adjacent channels in the other row.

7. A gutter screen as set forth in claim 6 wherein said member includes at least four rows of channels and wherein the channels in one of said rows are aligned with the channels of an immediately adjacent row in a direction transverse to said axis, said rows arranged to ensure that water flowing at an angle to the longitudinal axis flows into one of said channels.

8. A gutter screen and a gutter mounted adjacent a roof, the gutter screen covering the gutter and preventing debris from falling into the gutter, said gutter screen comprising:

an elongate sheet metal member sized and shaped to engage a portion of the gutter and to cover the gutter, said member having a longitudinal axis and a generally smooth top surface interrupted by a plurality of channels and slots formed therein, said channels extending generally transverse to said axis and said slots extending generally parallel to the axis, each channel extending down and away from the smooth top surface, each channel defining a concave profile in cross-section taken longitudinally with respect to the channel as the channel extends down and away from the top surface and further having a lower end that defines a lower portion of the periphery of one of said slots, said channels being aligned in rows extending parallel to said axis, a continuous, uninterrupted and unbroken portion of the top surface extending between adjacent channels and slots and between said rows, said channels being formed from the material of the sheet metal member, the upper end of each channel including a leading edge which is curved substantially along its full length, each first channel and first slot being sized and shaped so that water is directed into the channel, through the slot and into the gutter and so that debris is not trapped in the channel and the slot;

said gutter screen being mounted in the gutter such that the leading edge of each channel is positioned nearer to the roof than the slot at the lower end of the channel so that water flows over the leading edge and into the slot and does not generally flow over the slot.

9. A gutter screen as set forth in claim 8 wherein the leading edge of each channel is part elliptical.

10. A gutter screen as set forth in claim 8 wherein said member includes at least four rows of channels and wherein the channels in one of said rows are aligned with the channels of an immediately adjacent row in a direction transverse to said axis.

11. A gutter screen as set forth in claim 8 wherein said slots have a length of less than about 0.75 inches and have a height of less than about 0.16 inches, and wherein said channels have a length measured perpendicular to said axis of less than about 0.5 inches.

12. A gutter screen as set forth in claim 8 wherein said slots have a length of about 0.5 inches and a height of about 0.09 inches, and wherein said channels have a length measured perpendicular to said axis of about 0.25 inches.

13. A gutter screen for covering a gutter and preventing debris from falling into the gutter, said gutter screen comprising:

an elongate sheet metal member sized and shaped to engage a portion of the gutter and to cover the gutter, said member having a longitudinal axis and a generally smooth top surface interrupted by a plurality of channels and slots formed therein, said channels extending generally transverse to said axis and said slots extending generally parallel to the axis, each channel extending down and away from the smooth top surface and having a lower end that defines a lower portion of the periphery of one of said slots, said channels being aligned in rows extending parallel to said axis, a continuous, uninterrupted and unbroken portion of the top surface extending between adjacent channels and slots and between said rows, said channels being formed from the material of the sheet metal member, the upper end of each channel including a leading edge which extends generally transversely with respect to the channel and is curved substantially along its full length, each channel and slot being sized and shaped so that water is directed into the channel, through the slot and into the gutter and so that debris is not trapped in the channel and the slot.

14. A gutter screen as set forth in claim 13 in combination with the gutter which is mounted adjacent a roof, said gutter screen being mounted in the gutter such that the leading edge of each channel is positioned nearer to the roof than the slot at the lower end of the channel so that water flows over the leading edge and into the slot.

15. A gutter screen as set forth in claim 14 wherein the leading edge of each channel is part elliptical.

16. A gutter screen as set forth in claim 13 wherein said member includes at least four rows of channels and wherein the channels in one of said rows are aligned with the channels of an immediately adjacent row in a direction transverse to said axis.

17. A gutter screen as set forth in claim 13 wherein said slots have a length of less than about 0.75 inches and have a height of less than about 0.16 inches, and wherein said channels have a length measured perpendicular to said axis of less than about 0.5 inches.

18. A gutter screen as set forth in claim 13 wherein said slots have a length of about 0.5 inches and a height of about 0.09 inches, and wherein said channels have a length measured perpendicular to said axis of about 0.25 inches.

19. A gutter screen for covering a gutter and preventing debris from falling into the gutter, said gutter having a front wall, a flange extending from the front wall, and a back wall said gutter screen comprising:

an elongate sheet metal member sized and shaped to cover the gutter and to engage the flange of the gutter and a hanger on the back wall of the gutter, said member being resiliently bendable to an upwardly arched configuration in which the member is in pressure engagement with the gutter and the hanger, said sheet metal member having a front region sloped downward toward the front wall of the gutter when the sheet metal member is installed in the gutter and a rear region sloped downward toward the back wall of the gutter when the sheet metal member is installed in the gutter;

said sheet metal member having a longitudinal axis and a generally smooth top surface interrupted by a plurality of first channels and first slots formed therein, each first channel extending down and away from the smooth top surface and having a lower end that defines a lower portion of the periphery of one of said first slots, said first channels being formed from the material of the sheet metal member, the upper end of each first channel including a leading edge which is curved substantially along its full length, each first channel and first slot being sized and shaped so that water is directed into the first channel, through the first slot and into the gutter and so that debris is not trapped in the first channel and the first slot.

20. A gutter screen as set forth in claim 19 wherein at least some of the first channels are formed in the front region of the sheet metal member, said member further comprising a plurality of second channels and second slots formed in the rear region of the sheet metal member and sized and shaped so that water is directed through the second slot and into the gutter.

21. A gutter screen as set forth in claim 20 in combination with the gutter which is mounted adjacent a roof, said gutter screen mounted in the gutter such that said rear region slopes downward toward the roof and wherein said second channels extend up and away from the smooth top surface.

* * * * *

UNITED STATES PATENT AND TRADEMARK OFFICE

CERTIFICATE OF CORRECTION

PATENT NO. : 6,151,837
DATED : November 28, 2000
INVENTOR(S) : James Edward Ealer, Sr.

It is certified that error appears in the above-identified patent and that said Letters Patent is hereby corrected as shown below:

Column 6, claim 8,
Line 50, "each first channel and first slot" should read -- each channel and slot --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*